US006895724B2

(12) United States Patent
Naipawer, III

(10) Patent No.: US 6,895,724 B2
(45) Date of Patent: May 24, 2005

(54) LAMINATED HIP AND RIDGE ASPHALT SHINGLE

(75) Inventor: Michael P. Naipawer, III, Bloomingdale, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/910,830

(22) Filed: Aug. 4, 2004

(65) Prior Publication Data

US 2005/0005555 A1 Jan. 13, 2005

Related U.S. Application Data

(62) Division of application No. 10/124,336, filed on Apr. 17, 2002, now Pat. No. 6,813,866.

(51) Int. Cl.[7] ..... E04B 1/00; E04G 21/00; E04G 23/00

(52) U.S. Cl. ..... 52/748.1; 52/518; 52/276; 52/553

(58) Field of Search ..... 52/748.1, 518, 52/276, 553, 278, 555, 560, 746.11, 528, 540, 531, 57; 428/141

(56) References Cited

U.S. PATENT DOCUMENTS 3,913,294 A 10/1975 Freiborg ..... 52/518
4,835,929 A * 6/1989 Bondoc et al. ..... 52/518
5,247,771 A 9/1993 Poplin ..... 52/518
5,365,711 A 11/1994 Pressutti et al. ..... 52/518
5,467,568 A 11/1995 Sieling ..... 52/518

* cited by examiner

*Primary Examiner*—Carl D. Friedman
*Assistant Examiner*—Nahid Amiri
(74) *Attorney, Agent, or Firm*—William J. Davis; Imre Balogh

(57) ABSTRACT

Laminated hip and ridge asphalt shingle having a first, a second and a third layer laminated together by a lamination adhesive. The first layer is of two L-shaped configurations, each having a horizontal head portion and a vertical butt portion. The horizontal head portions are superimposed on each other, while the vertical butt portions are placed adjacent to each other and form a gap which allows bending of the first layer thereby preventing stress and breaking. The second layer overlaps the firs layer. The third layer only overlaps the head portion of the second layer. The top surface of the shingle is coated with mineral granules, while portions of the undersurface of the shingle are coated with a self-seal adhesive to secure the shingle to the hip or ridge of a roof. Disclosed also is a process for installing the hip and ridge shingle units which includes: bending a first unit along a central fold line, pressing and adhering it to both sides of the intersecting plane of a roof; nailing the unit to the roof deck on both sides of the hip or ridge; bending a second unit along a central fold line, pressing and adhering it to both sides of the intersecting plane and to the first unit so that the butt portion of the second unit overlaps the head portion of the first unit; nailing the second unit to the roof deck on both sides of the hip or ridge; and similarly securing the necessary additional units to the intersecting planes of the roof to complete the installation.

5 Claims, 9 Drawing Sheets

LAMINATED HIP AND RIDGE ASPHALT SHINGLE

CROSS REFERENCE TO RELATED APPLICATION

This application is a divisional of U.S. application Ser. No. 10/124,336 filed Apr. 17, 2002, now U.S. Pat. No. 6,813,866.

BACKGROUND OF THE INVENTION

1. Field of the Invention

This invention relates to hip and ridge shingles for covering the hip and ridge connections on the pitched roof of buildings.

2. Reported Developments

Hip and ridge shingle units are used in the building industry to cover the hips and ridges of various building structures. As such, they are designed with configurations and materials of construction, which allow them to cover angled areas of a roof structure. Several asphalt ridge shingles of various shapes and folding patterns have been proposed for peaks of pitched or gabled roofs to provide for water-impermeability and pleasing appearance. For example, U.S. Pat. No. 3,913,294 discloses a tapered asphalt ridge cover comprising a plurality of folds perpendicular to, and approximately midway down the longitudinal axis of the ridge cover with a fold at the front and to produce a small lip with asphalt adhesive on the lower surface of the front end. Another U.S. Pat. No. 5,247,771, discloses a ridge cover with first and second tapered portions in which the cover is formed by folding the unit such that the second tapered portion overlaps the first tapered portion.

Folding of roof ridge shingles tends to create stress and breakage along fold lines especially when the roof ridge shingles are installed in cold weather. U.S. Pat. No. 5,365,711 teaches a ridge cover composed of a particular composition containing a flexibility adhesive in which the roofing sheet is folded back on itself twice in the intermediate portion of the sheet in order to form a thickened portion midway the length of the sheet with inner sections extending forwardly and rearwardly from the thickened portion. The ridge cover further comprises a T-shaped slit extending through the thickened portion of the unit.

The present invention does not utilize folding of the hip and ridge roofing shingles and for that reason cracking or breaking the shingles during cold weather installation is eliminated.

SUMMARY OF THE INVENTION

In accordance with the present invention a hip and roof ridge shingle is provided comprising three layers of a base mat laminated together by an asphalt pressure sensitive adhesive material, the top, weather exposed surface of which is covered by inorganic granules embedded in an asphalt coating. The first and second layers are of equal size and, preferably, are of square configuration. Each of the two layers has a head portion and a butt portion. The third layer is laminated to the head portion of the second layer.

The first layer of the laminate is designed to conform to the hip and roof ridge of an underlying roof structure without breaking or cracking. To reduce the stress upon bending, the first layer is a combination layer comprising: two L-shaped portions, each of which have a horizontal top or head portion, and a vertical bottom or butt portion in which the head portions are superimposed on each other and the butt portions are positioned adjacent to each other in such a way that a small discontinuity or gap is formed therebetween. The resulting gap forms an air space that closes once the product is bent in position and installed. The undersurface of the first layer is provided with a self-seal adhesive, covered by a release paper, for attachment to a roof hip or ridge. The top surface of the first layer is provided with lamination adhesives on its head and butt portions to receive and secure the second layer of the laminate.

The second layer of the laminate is equal in size with the first laminate and is superimposed on the first layer of the laminate. It carries at least one strip of lamination adhesive on its head portion to receive and secure the third layer of the laminate.

The third layer of the laminate is approximately equal to the size of the head portion of the laminate. Upon installation of the shingle units on hip and ridge surfaces of a roof this third layer will be covered by at the butt portions of the first and second layers.

The lamination adhesives used between the layers allow the layers to float or slide past each other as the shingle unit is bent over the hip or ridge of a roof. This sliding effect greatly reduces the surface tension present on the layers. The self-seal adhesives on the undersurface of the first layer reduces the blow-off potential. The laminate, preferably, is secured to the roof deck by nailing two standard roofing nails in the head portion, thus, penetrating and securing all three layers.

Examplary adhesives mentioned above include the following:

Self-Seal—Shingle tab adhesive part no. 34562 manufactured by Crafco Incorporated (6975 W. Crafco Way, Chandler, Ariz. 85226)

Properties:

Softening Point—ASTM 36=190–220° F.

Penetration @ 77° F.—ASTM D5=20–40

Thermosel Viscosity @ 350° F.—ASTM D 4402=500–1500 cp

Ductility @ 77° F.—ASTM D 113=75 cm Min.

Flash Point=ASTM D 92=475 min.

Lamination Adhesive—Laminating adhesive part no. 34557 manufactured by Crafco Incorporated (6975 W. Crafco Way, Chandler, Ariz. 85226)

Properties:

Softening Point—ASTM 36=180° F. min.

Penetration @ 77° F.—ASTM D5=50–75

Thermosel Viscosity @ 350° F.—ASTM D 4402=250–750 cp

Ductility @ 77° F.—ASTM D 113=50 cm min.

Flash Point=ASTM D 92=475 min.

Both adhesive products may be further modified by addition of Limestone filler/stabilizer from 0.5–50% by weight of adhesive.

Both adhesive products may be further modified by addition of Asphalt (Type III) per ASTM D312 form 0.5–50% by weight of adhesive.

BRIEF DESCRIPTION OF THE DRAWINGS

For a more detailed description of the invention reference is now made to the accompanying drawings of which.

DETAILED DESCRIPTION OF THE INVENTION

Reference is made to the drawings showing the details of the laminated hip and ridge asphalt shingle of the present invention.

Figure 1:
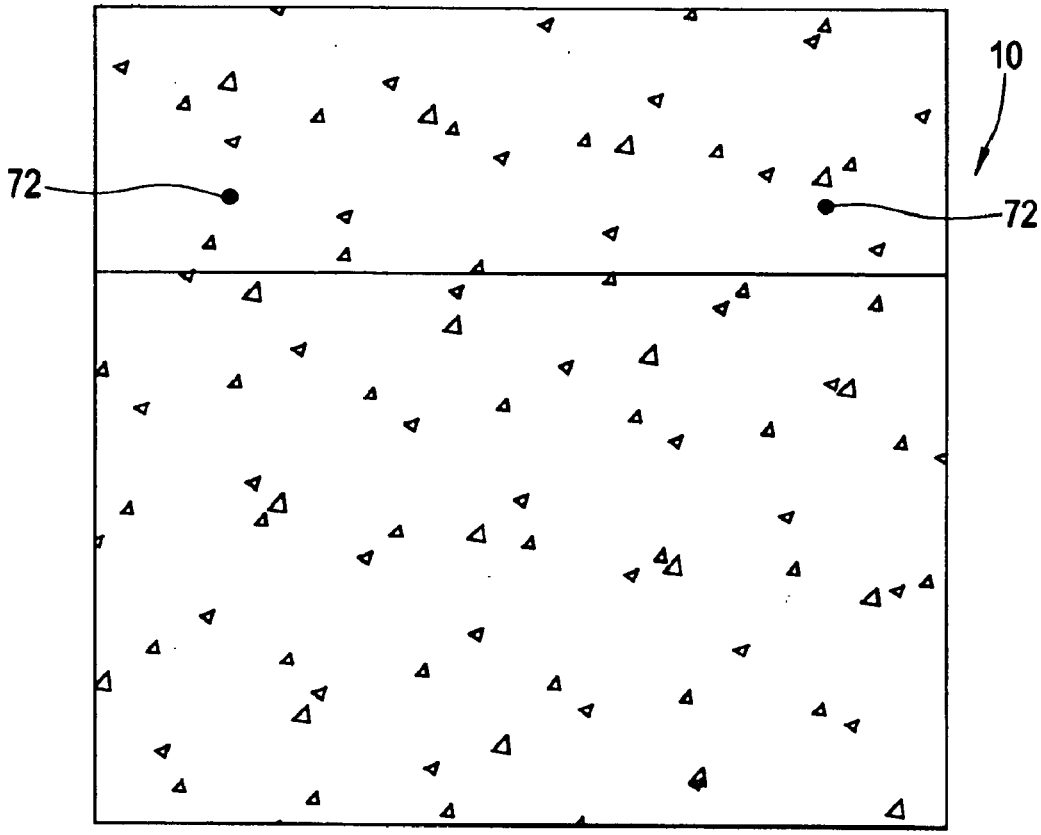
FIG. 1 is a top plan view of a laminated hip and ridge asphalt shingle.

FIG. 1 shows a top plan view of the laminated hip and ridge asphalt shingle generally designated as 10. The top surface thereof comprises a layer of granules embedded in an asphalt coating of a base mat. The granules may be artificially colored mineral granules containing titanium dioxide to obtain a white or light-colored appearance in the shingles, or granules with coatings thereon of iron oxide doped with aluminum and manganese oxides to obtain a metallic copper appearance. To obtain a decorative contrast on the laminated hip and ridge asphalt shingles when installed, one of said shingles might be white or light-colored, while the other may be of a metallic copper appearance.

Figure 2:
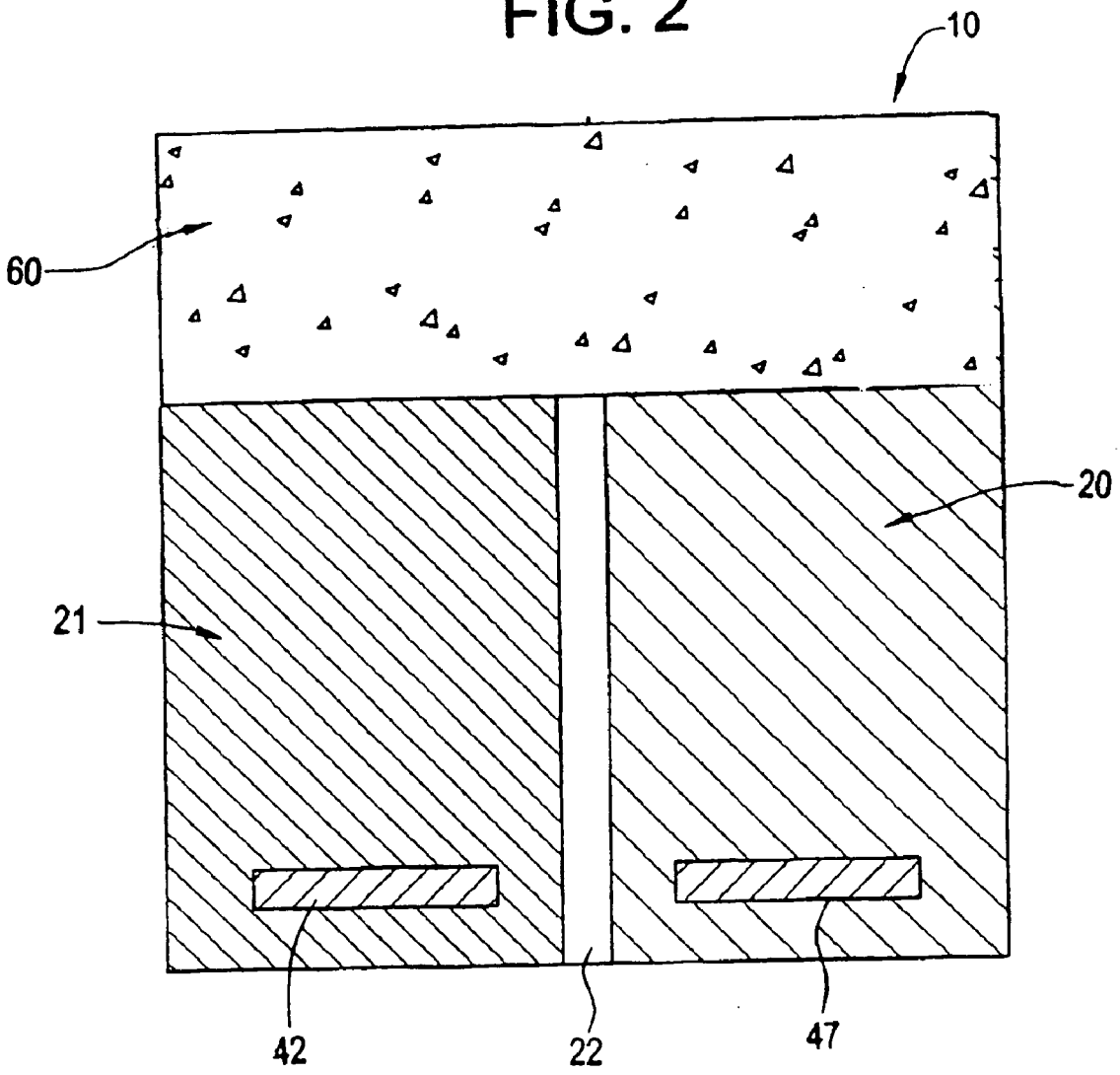
FIG. 2 is a top plan view of the first layer of the laminated hip and ridge asphalt shingle comprising two L-shaped configurations, each said configuration having a horizontal top portion and a vertical portion wherein one horizontal top portion completely overlaps the other horizontal top portion, and one vertical bottom portion is adjacent to the other vertical bottom portion forming a gap therebetween.
Figure 6:
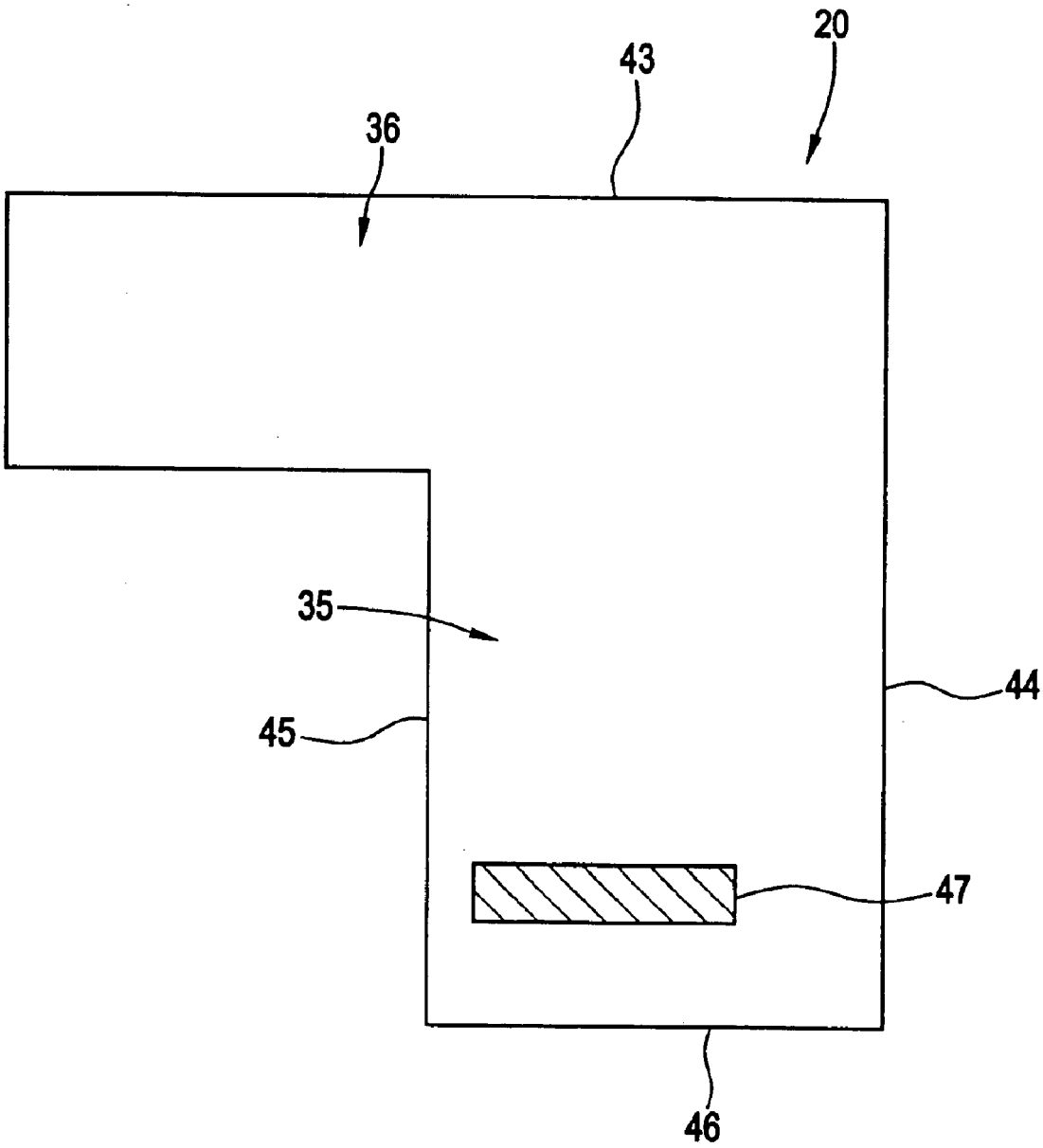
FIG. 6 is a top plan view of the upper L-shaped layer having an L-shaped configuration.

FIG. 2 shows a top plan view of the first layer of the laminated hip and ridge asphalt shingle. The first layer comprises two portions which are mirror images of each other comprising: upper L-shaped layer 20 and lower L-shaped layer 21. Upper L-shaped layer 20 is superimposed on lower L-shaped layer 21 in such a way that their lower portions do not cover each other but have a discontinuity or gap 22 therebetween. Upper L-shaped layer 20 is shown in FIG. 6 while lower L-shaped layer 21 is shown in FIG. 4 separately prior to being superimposed on each other.

Figure 3:
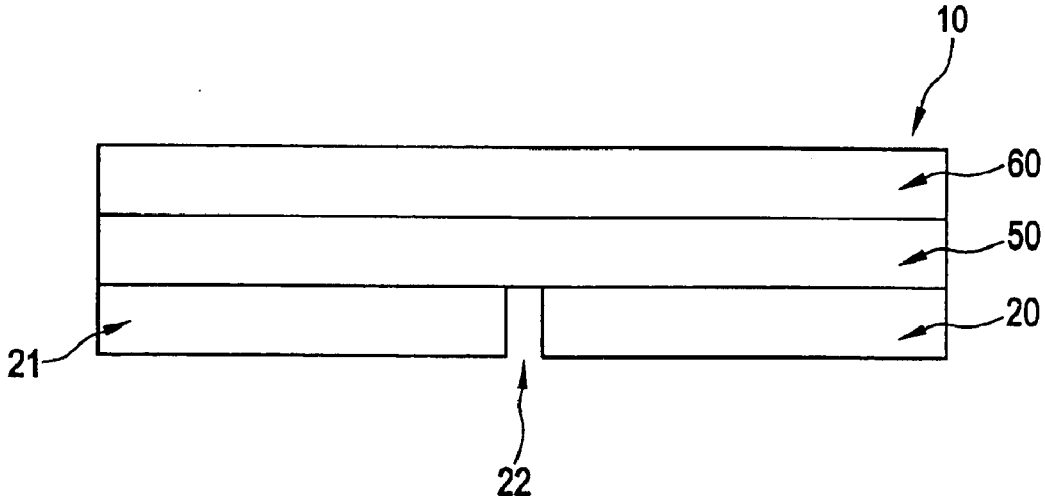
FIG. 3 is an end elevational view of the laminated hip and ridge asphalt shingle showing a small gap in the center portion thereof between the upper and lower L-shaped layers.

FIG. 3 is an end elevational view of the laminated hip and ridge asphalt shingle 10 showing: upper and lower L-shaped layers 20 and 21; middle or second layer 50; and top or third layer 60. The upper and lower L-shaped layers have a discontinuity or gap 22 in the center portion thereof which serves as an air space that closes once the laminated hip and ridge asphalt shingle is bent over the hip ridge of the roof and installed.

Each of the layers in top and undersurface plan views forming the laminated hip and ridge asphalt shingle of the present invention prior to lamination to each other is described hereunder in connection with FIGS. 4, 5, 6, 7, 8 and 9.

Figure 4:
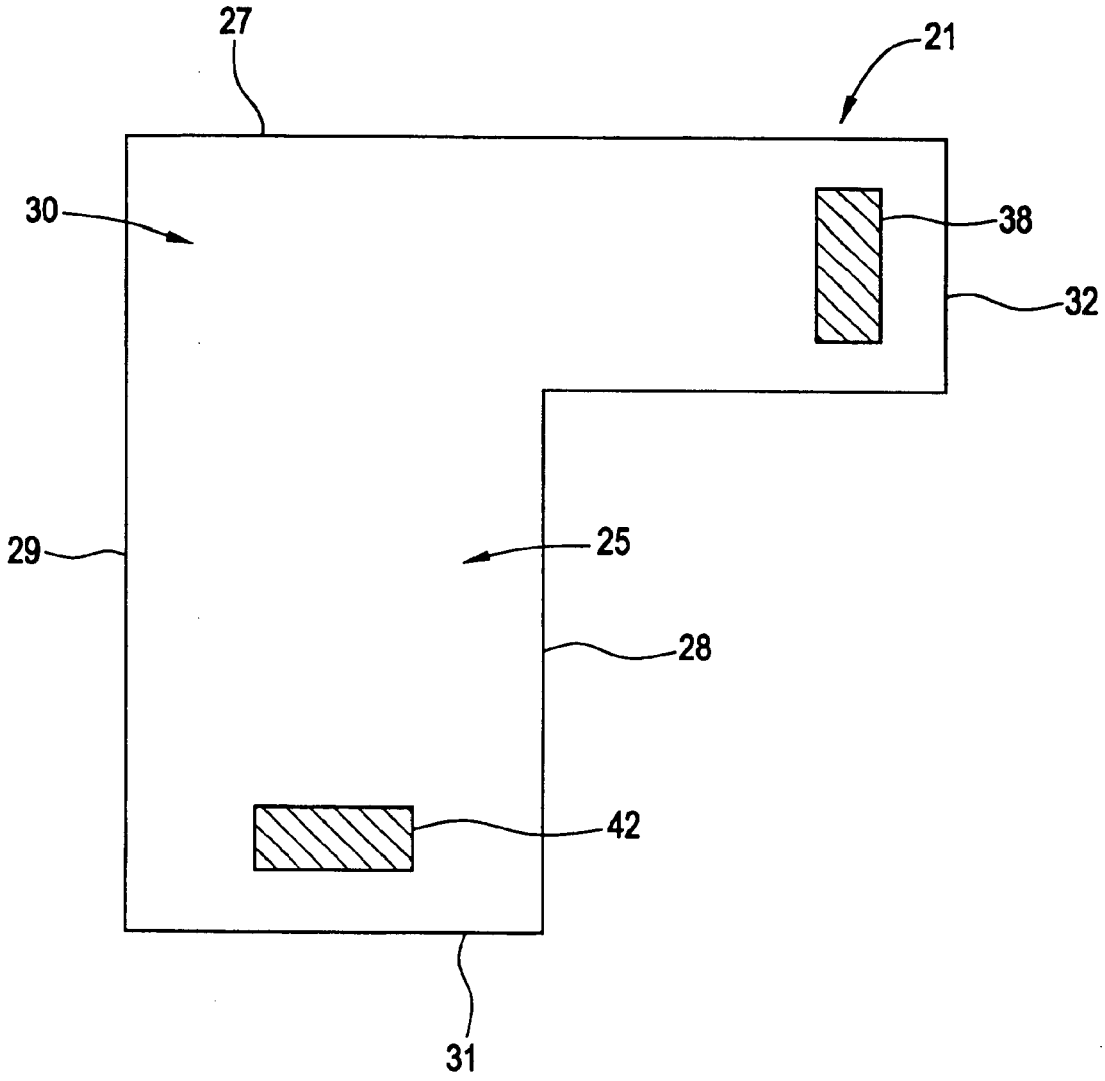
FIG. 4 is a top front plan view of the lower L-shaped (bottom) layer having an L-shaped configuration.

FIG. 4 is top front plan view of the lower L-shaped layer 21 having an L-shaped configuration.

The L-shaped layer 21 has a vertical portion 25, and a horizontal portion 30, both of which are generally designated. The layer is further defined by top end 27 in the horizontal portion, side ends 28 and 29 in the vertical portion, side end 32 in the horizontal portion, and bottom end 31 in the vertical portion 25. The layer is provided with a lamination adhesive well-known as asphalt adhesive, in the top surface thereof: adjacent to bottom end 31 there is a horizontal lamination strip 42 running parallel to bottom end 31, and lamination strip 38 running parallel to side end 32 in the horizontal portion 25. Lamination adhesive strip 42 serves to receive and adhere to the second or middle layer 50, while lamination adhesive strip 38 serves to secure lower L-shaped layer to upper L-shaped layer.

Figure 5:
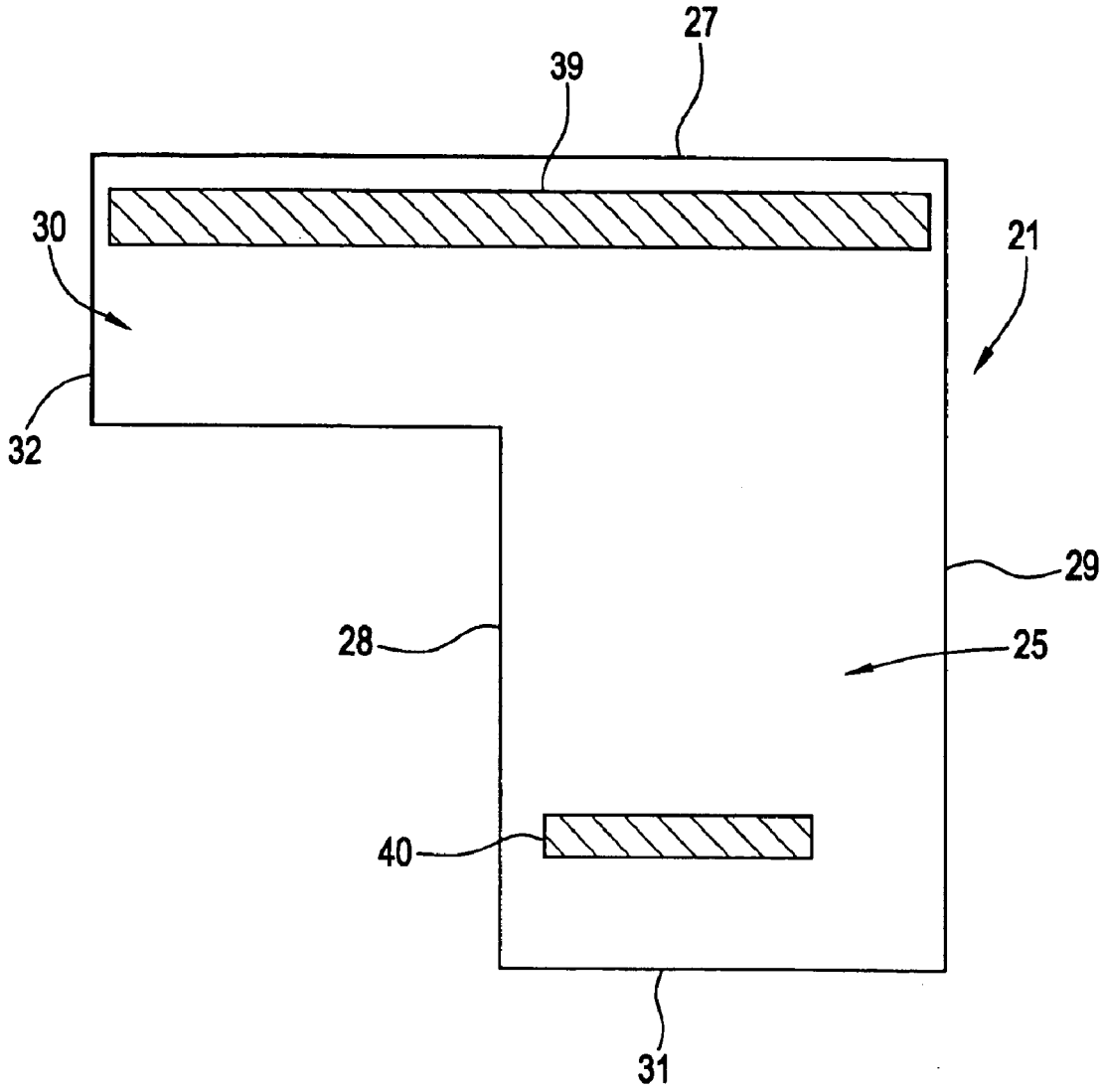
FIG. 5 is a back side or undersurface plan view of the lower L-shaped (bottom) layer having an L-shaped configuration.

FIG. 5 is a back side or undersurface plan view of the lower L-shaped layer shown in top front plan view in FIG. 4. The back side is characterized by: top end 27; bottom end 31; side ends 28 and 29 in the vertical portion; and side end 32 in the horizontal portion. The horizontal portion and the vertical portion of the L-shaped layer 21 are generally designated at 30 and 25 respectively. The back side is equipped with: release tape 39 running parallel and spaced adjacent to top end 27; and self-seal adhesive strip 40 running parallel and spaced from bottom end 31. The release tape 39 is a silicone coated polyester tape.

FIG. 6 is a top front plan view of the upper L-shaped layer of the shingle, generally designated at 20. The top front plan view is characterized by: top end 43; bottom end 46; side ends 44 and 45, respectively. The horizontal portion and the vertical portion of the layer are generally designated at 36 and 34, respectively. The top surface is equipped with a lamination adhesive strip running parallel and adjacent to the vertical bottom end 46 and secures the upper L-shaped layer to middle layer 50.

Figure 7:
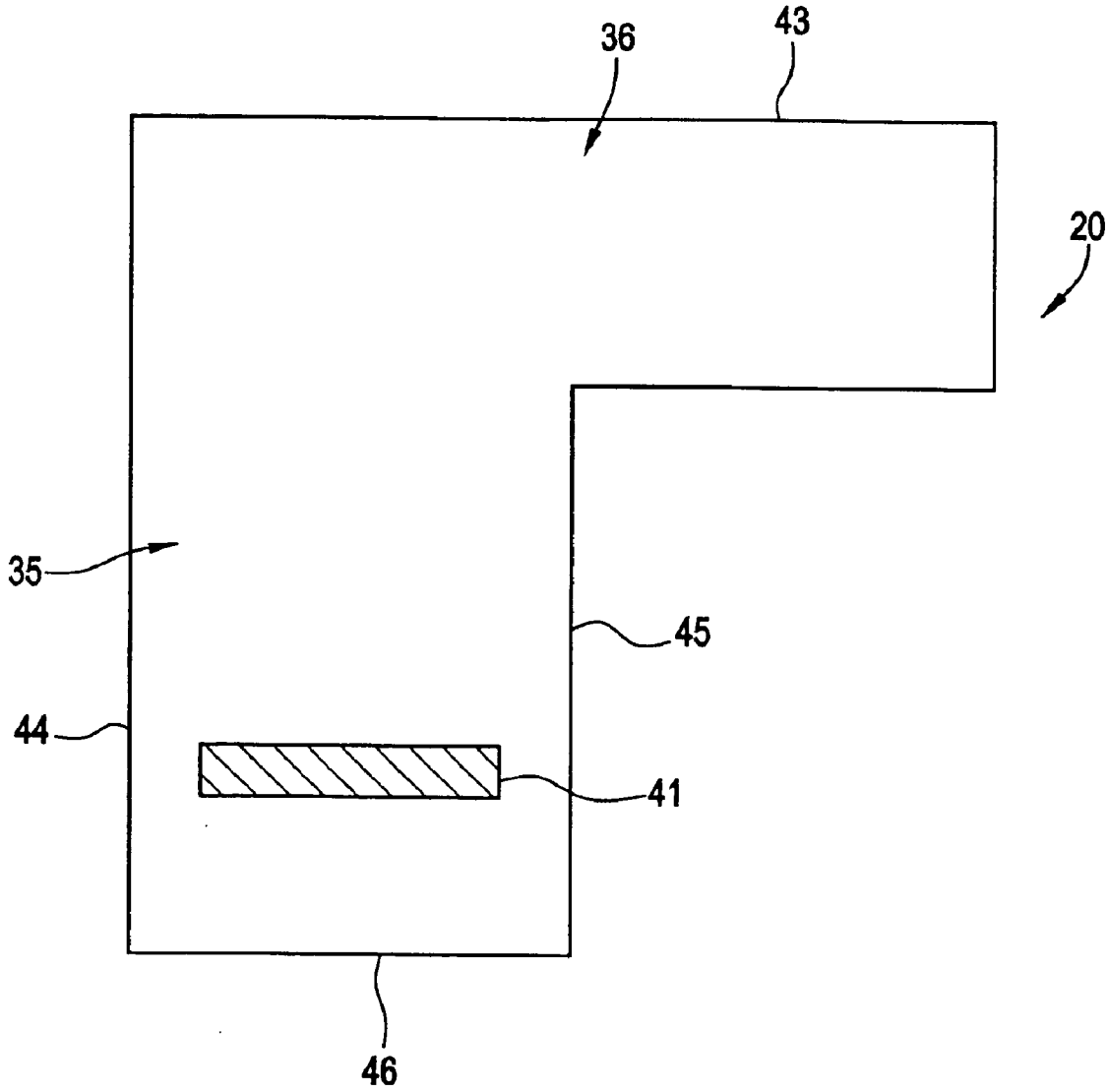
FIG. 7 is a back side or undersurface plan view of the upper L-shaped layer having an L-shaped configuration.

FIG. 7 is a back side or undersurface plan view of the upper L-shaped layer of the shingle, generally designated at 20 shown in FIG. 6. The horizontal portion and the vertical portion of the layer are generally designated at 36 and 35 respectively. The layer is further defined by: top end 43; bottom end 46; and side ends 44 and 45. The bottom surface is equipped with a self-seal lamination adhesive strip 48 running parallel and adjacent to the vertical bottom end 46.

The production of the laminated hip and ridge asphalt shingle of the present invention typically comprises the following steps.

The top surfaces of each of the layers are coated with mineral granules subsequent to which lamination adhesives and self-seal adhesives are deposited thereon as shown in the above-described figures. Lamination adhesives are used on top surfaces of each layer, while self-seal adhesives are used on the back or undersurfaces of the layers. Release tape 39 is used on the back or undersurface of the lower L-shaped layer of the shingle to facilitate packaging. In making the laminated hip and ridge asphalt shingle 10, upper L-shaped layer 20 is superimposed on lower L-shaped layer 21 so that their horizontal portions essentially cover each other. Side end 45 in upper L-shaped layer 20 and side end 28 in lower L-shaped layer 21 do not overlap each other: a gap between the upper and lower L-shaped layers separates the side ends from each other prior to positioning the laminated hip and ridge asphalt shingle on the peak of the roof. This gap allows bending of the layers without the risk of cracking. The gap being of about 0.5 to about 1.5 inches will be closed on bending the layers on the peak of the roof. The release tape 39 on the back side or undersurface of layer 21 allows stacking of the laminated hip and ridge asphalt shingles on top of each other during shipping and installation.

Figure 8:
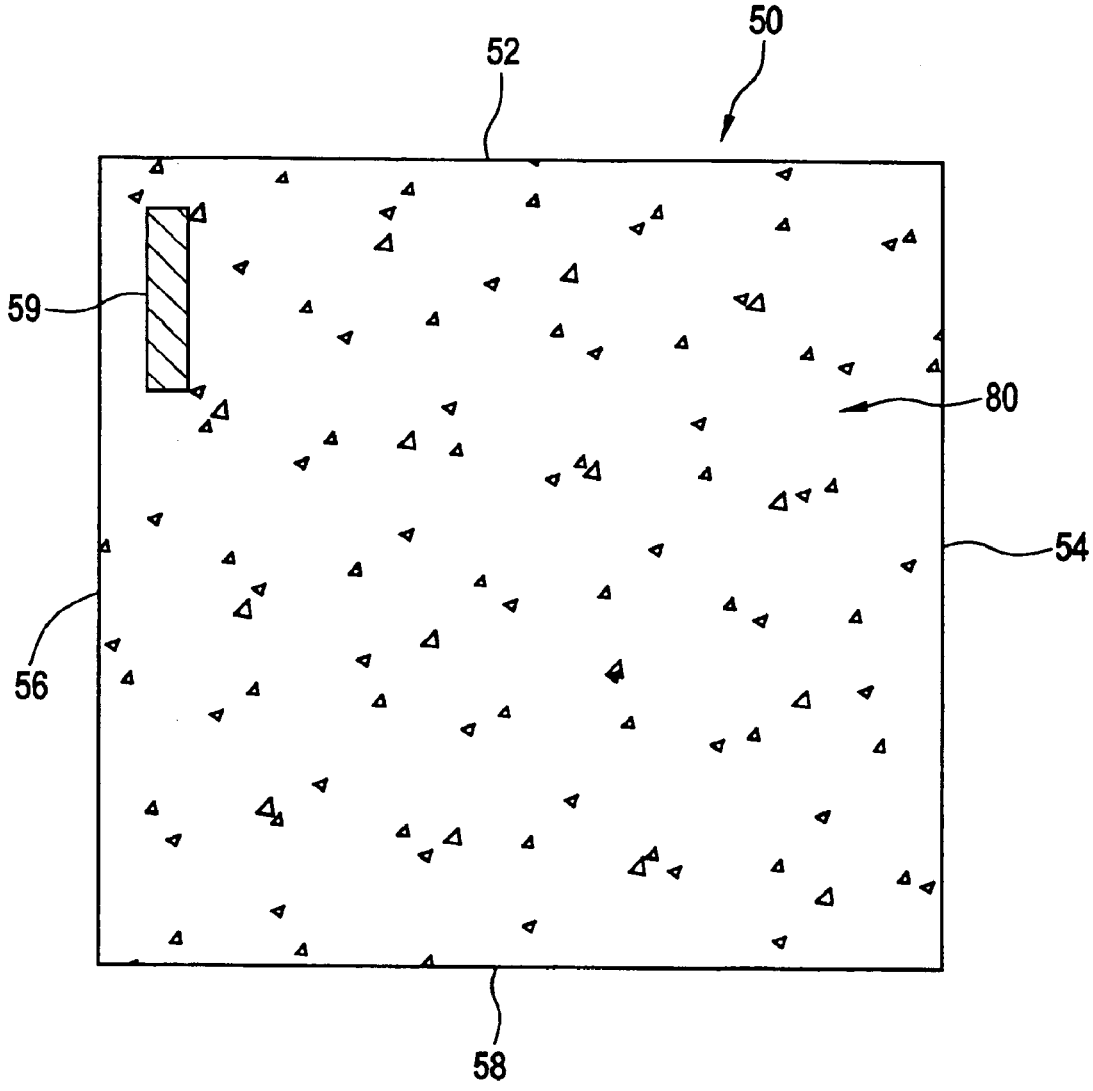
FIG. 8 is a top or front plan view of the second or middle layer of the laminated hip and ridge asphalt shingle.

FIG. 8 illustrates in a top plan view the second or middle layer 50 of the laminated hip and ridge asphalt shingle 10. The layer is defined by: top end 52; bottom end 58, and side ends 54 and 56. A lamination adhesive stripe 59 is positioned running parallel to side end 56. The layer is coated with mineral granules prior to depositing the lamination adhesive thereon. The size of layer 50, similarly to layers 20 and 21, is about 12"×12". Layer 50 is superimposed on layers 20 and 21 and completely covers them. Layer 50 is secured to upper L-shaped layer 20 by lamination adhesive strip 47 and to lower L-shaped layer 21 by lamination adhesive strip 42.

Figure 9:
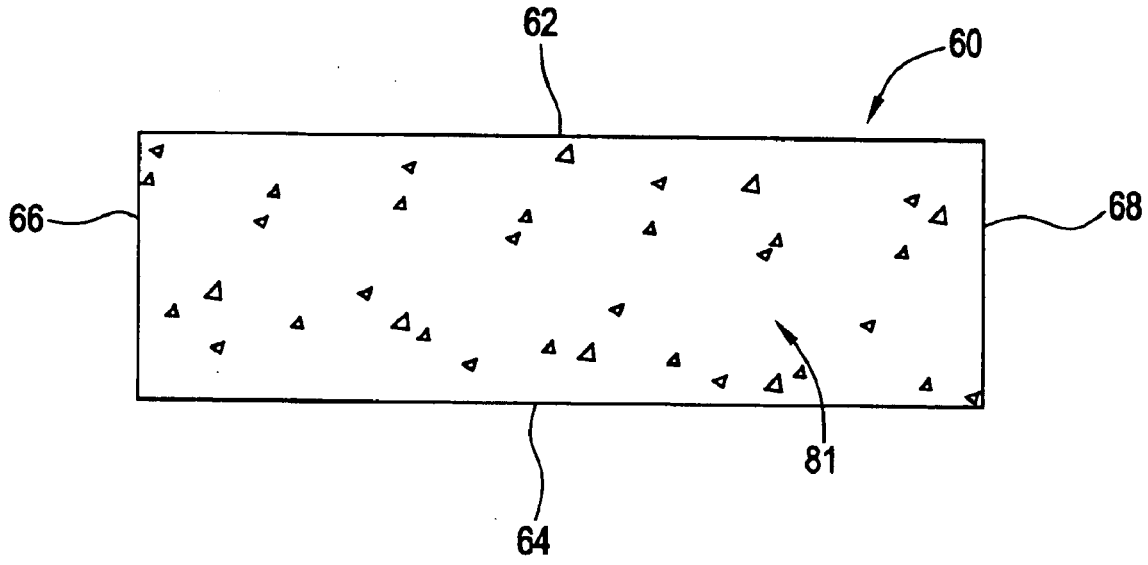
FIG. 9 illustrates in a top plan view the top layer of the laminated hip and ridge asphalt shingle.

FIG. 9 illustrates in a top plan view the third or top layer 60 of the laminated hip and ridge asphalt shingle wherein the layer is defined by top end 62, bottom end 64, and side ends 66 and 68. The size of the layer is about 4"×12" and is coated with mineral granules subsequent to which it is positioned on the top upper portion of layer 50 so that top end 62 and side ends 66 and 68 cover top end 52 and side ends 54 and 56 in layer 50. Lamination adhesive stripe 59 in layer 50 securely holds layer 60.

Figure 10:
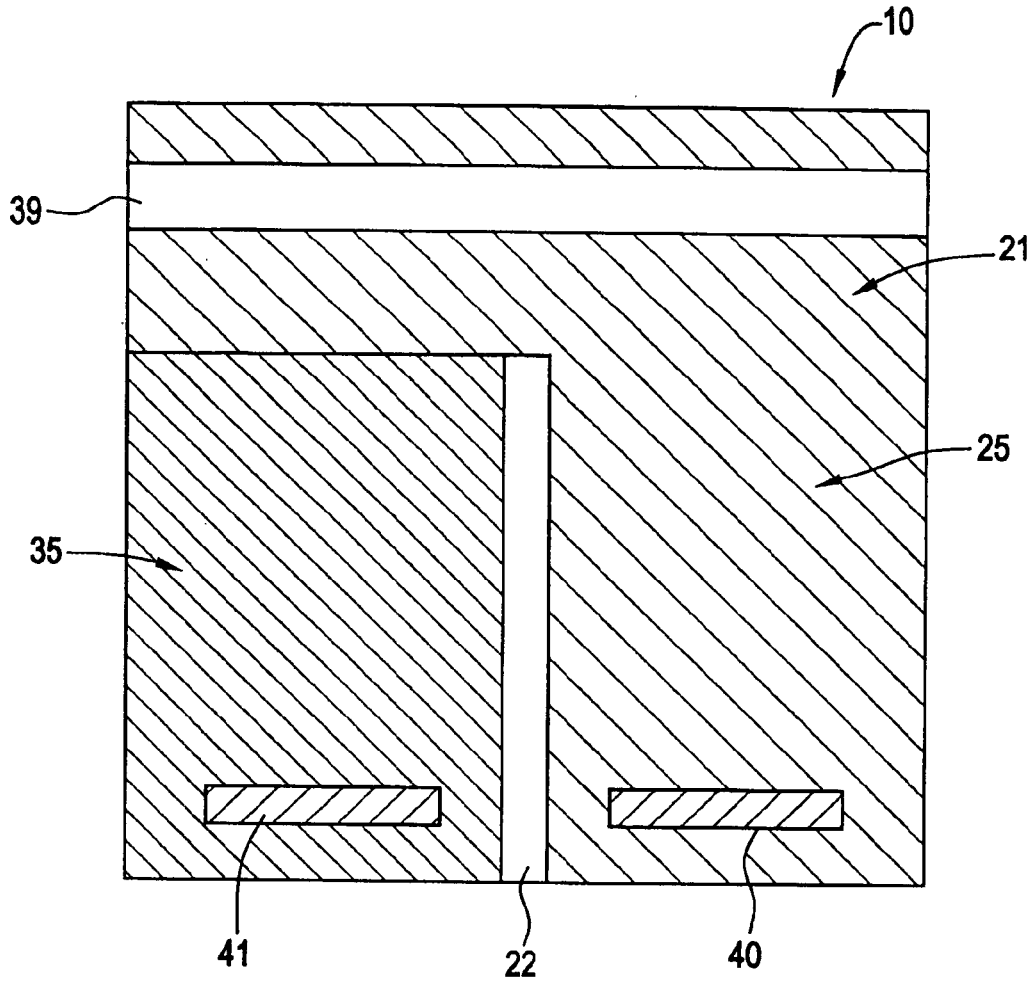
FIG. 10 shows in a plan view the backside or undersurface of the laminated hip and ridge asphalt shingles combining two self-seal adhesive strips or dots and a shingle release tape.

FIG. 10 shows in a plan view the underside of the laminated hip and ridge asphalt shingle 10 completely coated with a self-seal adhesive except at gap 22. While complete coating is illustrated in FIG. 10, which is preferred, partial coating with self-seal adhesive strips may also be used. In either case a release paper is used on the coating to provide for convenient handling which is then removed upon installation of the shingles. The self-seal adhesive securely holds the shingles on the hip or ridge of the roof. However, upon installation, nails are used as shown in FIG. 11.

Figure 11:
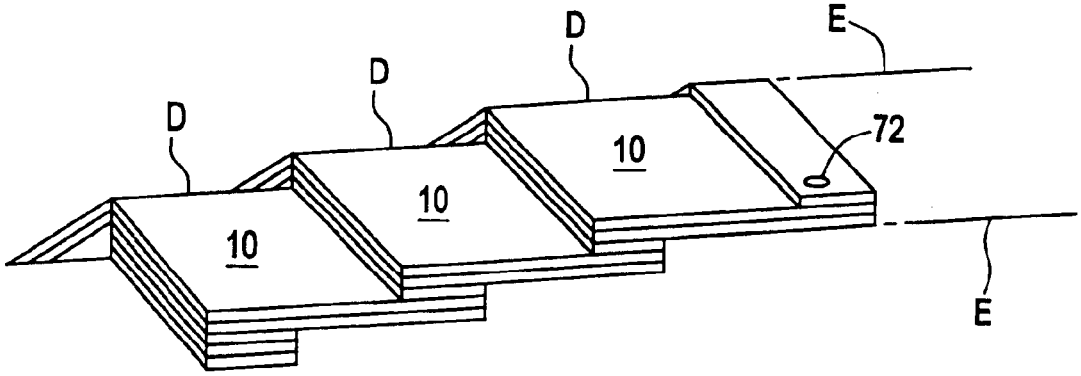
FIG. 11 shows a partial perspective view of the hip and ridge asphalt shingles laid on a roof hip or ridge.

FIG. 11 is a partial perspective view of the hip and ridge asphalt shingles 10 laid on the roof ridge wherein:

E denotes the plain of the roof hip or ridge;

D denotes the ridge of the units 10; and the numeral 72 denotes the nail. At least one nail is used on each side of the shingle covering the hip or ridge.

The process of installing the hip and ridge asphalt shingles of the present invention includes the steps of:

laying and bending unit 10 to the plane of the roof E on both sides of the ridge by pressing the unit on the roof for adherence thereto;

nailing the unit to both sides of the ridge;

positioning and bending a second unit 10 in an overlapping manner over the first unit 10 so that the head portion of the first unit is completely overlapped by the butt portion of the second unit;

securing the second unit 10 to the first unit and to the plane of the roof E on both sides of the ridge by pressing and nailing the unit; and continuing the process until the roof ridge deck is completely covered by the hip and ridge asphalt shingles of the present invention.

| PARTS LIST | |
|---|---|
| Laminated hip and ridge asphalt shingle, generally designated | 10 |
| Upper L-shaped layer of shingle, generally designated | 20 |
| Lower L-shaped layer of shingle, generally designated | 21 |
| Middle layer of shingle, generally designated | 50 |
| Top layer of shingle, generally designated | 60 |
| Gap in the center portion between upper and lower L-shaped layers | 22 |
| Vertical portion of lower L-shaped layer 21, generally designated | 25 |
| Horizontal portion of lower L-shaped layer 21, generally designated | 30 |
| Top end of horizontal portion of lower L-shaped layer 21 | 27 |
| Side ends of vertical portion of lower L-shaped layer 21 | 28, 29 |
| Bottom end of vertical portion of lower L-shaped layer 21 | 31 |
| Side end of horizontal portion of lower L-shaped layer 21 | 32 |
| Vertical portion of upper L-shaped layer 20, generally designated | 35 |
| Horizontal portion of upper L-shaped layer 20, generally designated | 36 |
| Lamination adhesive strip in horizontal portion 30 of lower L-shaped layer to secure lower L-shaped layer to upper L-shaped layer | 38 |
| Shingle release tape | 39 |
| Self-seal adhesive strip on the back side or undersurface of lower L-shaped layer 21 to secure the layer to the next shingle course | 40 |
| Self-seal adhesive strip on the back side or undersurface of upper L-shaped layer 21 to secure the layer to the next shingle course | 41 |
| Lamination adhesive strip in vertical portion of lower L-shaped layer 21 to secure the layer to middle layer | 42 |
| Top end of horizontal portion of upper L-shaped layer 20 | 43 |
| Side ends of vertical portion of upper L-shaped layer 20 | 44, 45 |
| Bottom end of vertical portion of upper L-shaped layer 20 | 46 |
| Lamination adhesive strip in vertical portion of upper L-shaped layer 21 to secure the layer to middle layer 50 | 47 |
| Top end of middle or second layer | 52 |
| Side ends of middle or second layer | 54, 56 |
| Bottom end of middle or second layer | 58 |
| Lamination adhesive strip in middle or second layer to secure the layer 50 to the upper L-shaped layer 20 | 59 |
| Top end of top layer | 62 |
| Bottom end of top layer | 64 |
| Side ends of top layer | 66, 68 |
| Nail in hip and ridge asphalt shingle | 72 |
| Granular surfacing in second or middle layer 50 | 80 |
| Granular surfacing in top layer | 81 |

Having described the invention in considerable detail, it should be noted that the invention is not limited thereto since alternative embodiments will become apparent to those skilled in the art. Accordingly, modifications are contemplated which can be made without departing from the spirit of the described invention.

What is claimed is:

1. A process for installing a laminated hip and ridge asphalt shingle along intersecting planes of a roof having an intersecting angle of less than 180° comprising the steps of:

1) providing a hip and ridge asphalt shingle of essentially rectangular configuration adapted to be bent along a fold line to conform to a roof hip or ridge comprising three layers:

a first layer having a top surface and an undersurface comprising two L-shaped portions each having a horizontal portion and a vertical portion, a top surface and an undersurface wherein said horizontal portions are superimposed on each other and said vertical portions are positioned adjacent to each other forming a gap therebetween, said gap allowing bending of the layer to conform to a hip or ridge on a roof surface, wherein portions of said top surface are coated with a lamination adhesive, and portions of said undersurface are undercoated with a self-seal adhesive;

a second layer having a top surface and an undersurface and comprising a head portion and a butt portion, superimposed on said first layer and adhered thereto by the lamination adhesive on said first layer, wherein at least a portion of the top surface is coated with a lamination adhesive; and a third layer having a top surface and an undersurface covering the head portion of said second layer; wherein the top surface of each layer is coated with mineral granules;

2) bending said laminated hip and ridge asphalt shingle along its gap in said first layer for conformance to the intersecting planes of said roof;

3) placing a first laminated hip and ridge asphalt shingle on the intersecting planes of said roof and pressing it for adherence thereto;

4) nailing the first laminated hip and ridge asphalt shingle to the roof deck on both sides of the hip or ridge;

5) placing a second laminated hip and ridge asphalt shingle over the intersecting planes of said roof so that the butt portion thereof overlaps the head portion of said first laminated hip and ridge asphalt shingle and bending and pressing it for adherence thereto;

6) nailing the second laminated hip and ridge asphalt shingle to the roof deck on both sides of the hip or ridge;

7) repeating steps 5 and 6 for mounting and securing a successive number of the hip and ridge asphalt shingles to complete the installation over the intersecting planes of the roof.

2. The process for installing a laminated hip and ridge asphalt shingle of claim 1 wherein said laminated hip and ridge asphalt shingle is of square configuration.

3. The process for installing a laminated hip and ridge asphalt shingle of claim 1 wherein said first and second layers of said laminated hip and ridge asphalt shingle have a width of 12 inches and a length of 12 inches.

4. The process for installing a laminated hip and ridge asphalt shingle of claim 1 wherein said third layer of said laminated hip and ridge asphalt shingle overlaps the head portion of said second layer.

5. The process for installing a laminated hip and ridge asphalt shingle of claim 1 wherein said first and second layers of said hip and ridge asphalt shingle have a width of 12 inches and a length of 12 inches, and said third layer has a width of 12 inches and a length of 4 inches.

* * * * *